United States Patent [19]

Knape

[11] 4,200,231

[45] Apr. 29, 1980

[54] FUEL INJECTOR NOZZLE

[75] Inventor: Richard S. Knape, Grand Rapids, Mich.

[73] Assignee: General Motors Corporation, Detroit, Mich.

[21] Appl. No.: 916,963

[22] Filed: Jun. 19, 1978

[51] Int. Cl.[2] ..... F02M 45/10

[52] U.S. Cl. ..... 239/94; 239/96; 239/533.8; 239/533.9

[58] Field of Search ..... 239/93, 94, 96, 533.3, 239/533.8, 533.9

[56] References Cited

U.S. PATENT DOCUMENTS

| | | | |
|---|---|---|---|
| 2,985,378 | 5/1961 | Falberg | 239/96 |
| 3,442,451 | 5/1969 | DeNagel | 239/96 |
| 3,598,314 | 8/1971 | Bailey | 239/96 |
| 3,788,546 | 1/1974 | Bailey | 239/120 |

*Primary Examiner*—Richard A. Schacher
*Attorney, Agent, or Firm*—Arthur N. Krein

[57] ABSTRACT

A fuel injector nozzle includes a housing having a compartment therein divided by a valve seat disc into a control chamber of predetermined volume on one side of the valve seat disc and a fuel chamber on the other side thereof, the valve seat disc having an aperture therethrough to effect communication between the control chamber and the fuel chamber, the housing having an inlet to the fuel chamber and an outlet from the fuel chamber for injection of fuel into an engine cylinder, a check valve in the form of a sleeve movably positioned in the fuel chamber for controlling flow from the control chamber through the aperture in the valve seat disc to the fuel chamber, and an inwardly opening, spring biased injection valve positioned in the fuel chamber with its enlarged diameter stem end guided in the check valve sleeve and having its other end positioned to control fuel injection out through the outlet. Fuel pressure built-up in the control chamber due to leakage of fuel from the fuel chamber past the mating sliding surfaces of the injection valve and check valve forces the check valve to an open position whereby to release pressure from the control chamber between injection strokes of the injection valve whereby a regulated pressure is maintained in the control chamber to act on the enlarged diameter end of the injection valve.

3 Claims, 1 Drawing Figure

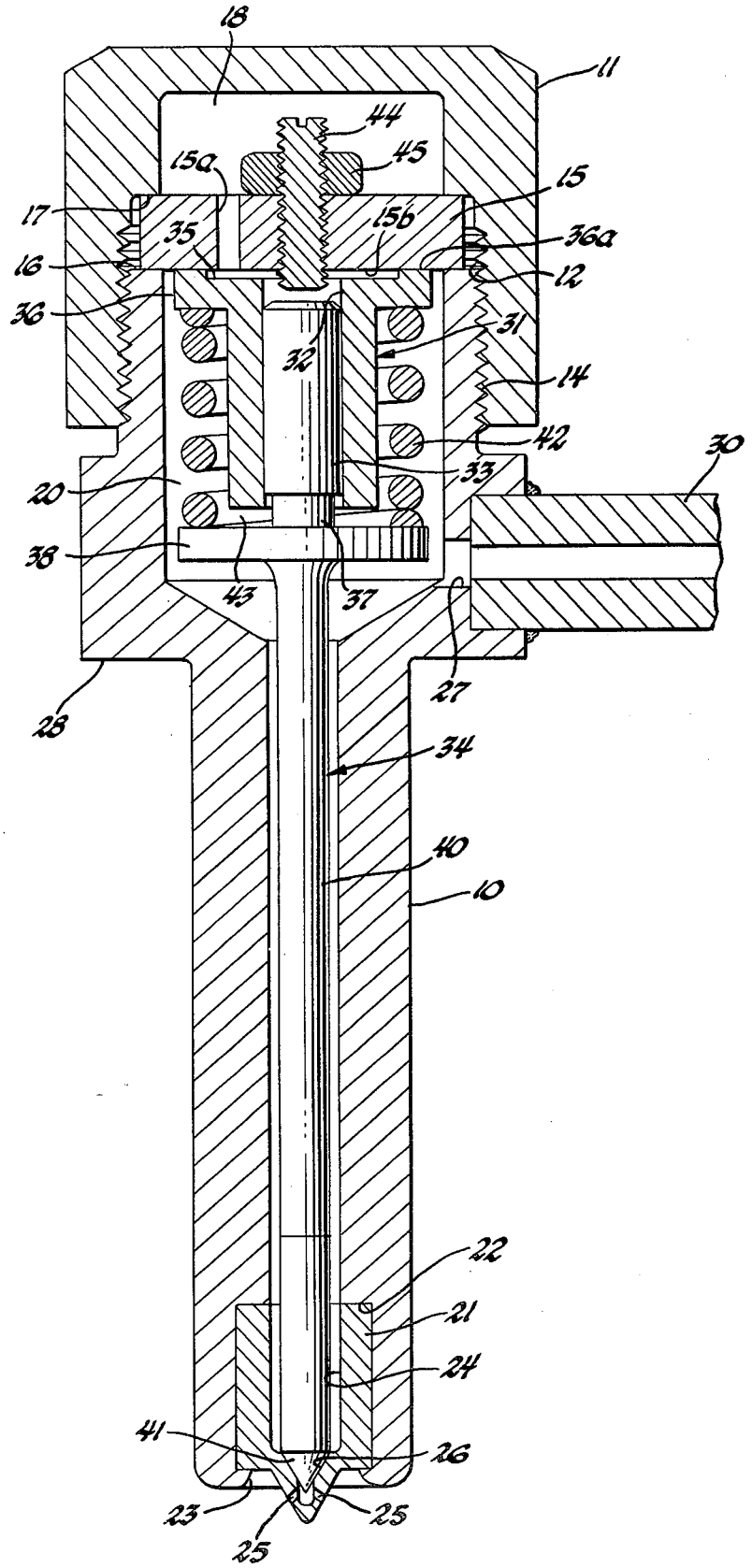
18
11
44
45
15a
15
17
35
15b
36a
16
12
36
31
32
14
42
30
33
20
38
43
37
27
28
34
40
10
22
21
24
41
26
23
25
25

FUEL INJECTOR NOZZLE

FIELD OF THE INVENTION

This invention relates to a device for injecting fuel into the cylinder of an internal combustion engine, and in particular, to a fuel injection nozzle.

BACKGROUND OF THE INVENTION

In diesel fuel injection systems of the type wherein a high pressure pump periodically supplies a quantity of fuel to an injector nozzle for injection into the cylinder of an engine, flow from such an injector nozzle is normally controlled by a pressure actuated valve, which may be either of the outwardly or inwardly opening type, with this valve being conventionally spring biased to its closed position.

Fuel injection nozzles having an inwardly opening valve normally utilize a differential area type valve therein and as such this type nozzle usually requires a drain conduit to be connected thereto for use in draining off any fuel which has leaked between cooperating elements of the valve assembly in such a nozzle. This is due to the fact that in this type nozzle arrangement, the nozzle assembly must be constructed so as to provide a low pressure chamber into which the stem of the valve extends in order to provide for the necessary pressure differential required to act on the valve to effect opening movement thereof against the closing bias of the conventional spring used to effect closing movement of the valve.

To eliminate the need for such a drain conduit in this type fuel injector nozzle, it has been previously proposed to provide in such a nozzle assembly an accumulator chamber into which fuel leakage can flow. However, such a fuel injection nozzle, with an accumulator chamber therein, may operate in an erratic manner due to the fact that, as the pressure of fuel gradually builds-up in the accumulator chamber due to continuous leakage of fuel past the cooperating elements of the valve assembly, the actual pressure differential pressure acting on the valve to effect valve opening movement will gradually decrease due to this buildup of pressure in the accumulator chamber and thus affects the nozzle opening pressure causing injection distribution errors. It will be apparent that, as this pressure in the accumulator chamber increases up to a value corresponding to that of the fuel being supplied by a pump to the injection nozzle, a hydraulic block can occur, which of course may prevent the injection valve from opening.

SUMMARY OF THE INVENTION

The present invention relates to a fuel injection nozzle that includes a housing means having a compartment therein divided by an apertured valve seat disc into a fuel chamber with a fuel inlet thereto and a fuel outlet therefrom on one side of the valve seat disc and a control chamber adapted to receive any fuel leakage past the valve element of the nozzle located on the opposite side of the valve seat disc. A check valve and an injection valve are positioned in the fuel chamber and are spring biased so as to respectively control fuel flow from the control chamber to the fuel chamber and to control fuel flow from the fuel chamber out through the outlet.

It is, therefore, a primary object of this invention to provide a fuel injection nozzle having a control chamber therein for receiving fuel leakage, with the pressure of fuel in this control chamber being relieved by means of a check valve which also serves as a guide for the injection valve of the nozzle assembly.

Another object of this invention is to provide a fuel injection nozzle of the type having a differential area type injection valve therein with means providing a chamber for any fuel leakage so that the pressure of this fuel can be controlled whereby the pressure differential acting on the injection valve can be regulated.

Another object of the present invention is to provide a fuel injection nozzle that is operative without the necessity of having a fuel leakage drain conduit connected thereto and which utilizes any leakage of fuel therein to affect the application of a uniform pressure force on one end of a differential area type injection valve controlling the discharge of fuel from the injection nozzle.

For a better understanding of the invention, as well as other objects and further featues thereof, reference is had to the following detailed description of the invention to be read in connection with the accompanying drawing.

BRIEF DESCRIPTION OF THE DRAWING

The drawing shows an enlarged, longitudinal sectional view of a fuel injection nozzle in accordance with a preferred embodiment of the invention.

DESCRIPTION OF THE PREFERRED EMBODIMENT

Referring now to the drawing, the fuel injection nozzle, in accordance with the invention, has an injector nozzle housing or body, of generally cylindrical configuration that includes a spray tip body 10 and an inverted, cup-shaped cap 11 suitably secured together as by having the internal threads 12 of the cap 11 threadedly engaged with the external threads 14 provided on the upper end of the spray tip body 10. A divider means in the form of a valve seat disc 15 is sealingly sandwiched between the upper rim 16 of the spray tip body 10 and an internal, annular shoulder 17 of the cap 11 to form with the cap 11 a control chamber 18 of predetermined volume on one side of the valve seat disc and to form with the axial stepped bore through the spray tip body 10 a fuel chamber 20 on the opposite side of the valve seat disc. Fluid communication between the fuel chamber 20 and the control chamber 18 is effected by means of an axial through passage **15*a* provided in the valve seat disc 15** radially outward a predetermined distance from the central axis of this disc.

In the construction shown, the spray tip body 10 has an injector tip 21 secured to its lower end, as by being sandwiched between a shoulder 22 and the swagged over lower flange 23 of the spray tip body 10. Injector tip 21, as thus positioned, has an axial passage 24 which is in communication at one end with the lower or reduced diameter end of fuel chamber 20 and which is in communication at its other end with one or more spray orifices 25 the spray tip being provided with an annular valve seat 26 located in the passage 24 upstream of the spray orifices 25 in terms of the direction of fuel flow through the passage 24 to the spray orifices.

Spray tip body 10, in the construction shown, is provided with a radial inlet port 27 located above the external mounting abutment shoulder 28 of this body, with this inlet port 27 opening at one end into the fuel chamber 20 and being in flow communication at its other end with conduit coupling 30 suitably secured to the body 10, as by being welded thereto, whereby the injection nozzle can be connected to a conventional fuel injection pump, not shown, suitable for delivering fuel under predetermined pulsating pressure.

Located within the upper end of fuel chamber 20 and laterally spaced from the internal wall of the spray tip body 10 defining this portion of the fuel chamber is a check valve 31 in the form of a sleeve or bushing having a central guide stem bore 32 therethrough for slidably engaging and supporting the upper, enlarged, predetermined diameter stem end 33 of a needle type injection valve, generally designated 34. The upper enlarged end of the check valve 31 is formed with an annular recessed cavity 35 encircling bore 32 and is provided with an axial extending flange 36 terminating at an annular valve rim **36*a* at its upper end of a suitable predetermined diameter. As shown, the predetermined minor radius of valve rim 36 is greater than the radial extent of passage 15*a*, whereby, when the check valve 31 is in the position shown with the valve rim 36 in abutment against the lower surface or valve seat 15*b* of the valve seat disc 15, it will be operative to act as a one-way check valve to block direct fluid communication from the fuel chamber 20 to the control chamber 18, while permitting flow in the opposite direction when the check valve 31** becomes unseated in a manner to be described.

In the embodiment shown, the injection valve 34 includes the upper enlarged diameter stem end 33, an intermediate reduced diameter stem portion 37 of predetermined diameter connecting the stem end 33 to an enlarged radial flange or collar 38 and, an elongated stem 40, also of predetermined diameter, depending from collar 38 to terminate at a conical valve tip 41 of a configuration to sealingly engage the valve seat 26.

A coil spring 42, of a predetermined spring load or force is positioned in the fuel chamber 20 to loosely encircle the lower end of the check valve 31 with one end thereof in abutment against the underside of flange 36 of the check valve and with its opposite end in abutment against the collar 38 of the injection valve. Spring 42 thus acts as a biasing means to normally maintain the check valve 31 closed against its valve seat **15*b* adjacent aperture 15*a* and the injection valve 34 closed against its valve seat 26 upstream of the spray orifices 25**.

When both the check valve 31 and the injection valve 34 are seated in their respective closed positions shown, a spacing 43 exists between the injection valve collar 38 and the lower end of the check valve 31, and the axial length of this spacing limits the maximum extent of opening of both valves. However, to accurately control the opening extent of movement of the injection valve 34, a valve stop element in the form of a screw 44 is adjustably threadedly received in a central internally threaded aperture provided for this purpose in the valve seat disc 15, a nut 45 being used to effect locking of the screw 44 in position.

In the operation of the subject fuel injection nozzle, fuel from a suitable fuel injection pump, not shown, is directed through the conduit coupling 30 and the inlet port 27 into the fuel chamber 20. The pressure of this fuel thus delivered into the fuel chamber 20 will then act on the differential area that exists between the respectively larger and smaller diameter upper and lower portions of the injection valve 34 and cause it to move in an axial direction against the bias of spring 42 to effect unseating of its valve tip 41 from the valve seat 26 thereby permitting fuel flow through the passage 24 to the spray orifices 25 whereby fuel is injected from these orifices into the combustion chamber of a cylinder, not shown. When the pressure of fuel in the fuel chamber 20 decreases sufficiently as the result of this injection, and due to the reverse flow of fuel through the conduit coupling 30 back to the pump in a conventional manner, if the outlets of the fuel pump, not shown, are each provided with check valves of the retraction type, the spring 42 will again return the injection valve 34 to its closed position, as shown, thereby terminating the injection.

During the delivery of pressurized fuel into the fuel chamber 20 and also during upward movement of the injection valve effecting valve opening, leakage of fuel will occur between the loosely fitted stem end 33 of the injection valve 34 and the wall of the stem guide bore 32 in the check valve 31, this fuel flowing from the bore 32 into the recessed cavity 35 and then from this cavity via the aperture **15*a* in the valve seat disc 15 into the control chamber 18**.

Assuming now that the control chamber 18 is full of fuel which has leaked to this chamber in the manner just described, during each cycle of operation when pressurized fuel is present in the fuel chamber 20 additional fuel will leak from this chamber past the sliding mating surfaces of the injector valve and check valve into the control chamber to increase the pressure of fuel therein. The pressure of this leakage fuel in the control chamber 18 will, however, be limited to some predetermined value dependent upon the predetermined volume of this control chamber and the bias force of the spring 42 since the differential pressure between the fuel in control chamber 18 and that in fuel chamber 20 acting on the check valve 31, when the fuel in fuel chamber 20 is at a reduced pressure, as at the termination of injection, will effect its unseating from its valve seat **15*b* against the bias of spring 42 to allow fluid flow from the control chamber 18 to the fuel chamber 20 via passage 15*a*. Accordingly, a substantially uniform, regulated control pressure, as desired, will be maintained in the control chamber 18 and therefore in recessed cavity 35 to act on the upper end of the valve stem 33 of injection valve 34. By thus maintaining a regulated pressure above the injection valve, nozzle opening pressure can be maintained constant. Thus any pressure buildup in the control chamber 18 above a predetermined value, will force the check valve 31 downward to unseat against the bias of spring 42 whereby this buildup of pressure will be relieved in between injection strokes of the injection valve, keeping the pressure of fuel in the control chamber 18** at a predetermined regulated pressure, as desired.

While only a single preferred embodiment of the invention has been shown and described, it is apparent that minor changes in the construction and arrangement of the parts may be made by those skilled in the art without departing from the spirit and scope of the invention. For example, although the injection valve has been illustrated and described as being a needle type valve, it will readily be apparent that an inward opening pintle valve could be used as the injection valve.

The embodiments of the invention in which an exclusive property or privilege is claimed are defined as follows:

1. A fuel injector nozzle assembly including an injector body providing a fuel chamber in communication with a recess having a spray outlet at one end of said injector body, a valve seat in said injector body defining the entrance to said recess, a cover member fixed to the opposite end of said injector body, a valve seat disc operatively fixed relative to said injector body for defining a control chamber with said cover member and for separating said control chamber from said fuel chamber, a fuel inlet in said injector body to said fuel chamber, a passage means through said valve seat disc providing for flow communication between said fuel chamber and said control chamber, a sleeve-like check valve movably positioned in said fuel chamber, said check valve having a central axial guide bore therethrough, an injection valve movably positioned in said fuel chamber of said injector body, said injection valve having a stem with a sealing portion, of a first predetermined diameter, at one end thereof engageable with said valve seat to block flow from said fuel chamber to said recess and a guide stem portion of a second predetermined diameter at its other end slidably received in said axial guide bore of said check valve, and a spring means operatively connected to said injection valve and to said check valve for normally biasing said injection valve in a direction whereby said sealing portion engages said valve seat and for normally biasing said check valve sleeve in a direction for sealing abutment against one side of said valve seat disc to block flow between said fuel chamber and said secondary chamber through said passage means, while accommodating opening movement of said injector valve relative to said valve seat when a predetermined fuel pressure exists in said fuel chamber and accommodating opening movement of said check valve relative to said valve seat disc when there is a predetermined pressure differential between said fuel chamber and said control chamber whereby to provide for a regulated pressure in said control chamber to act on the free end of said guide stem portion of said injection valve.

2. A fuel injector nozzle including an injector body means providing a compartment therein, a divider means fixed to said injector body means to divide said compartment into a control chamber on one side of said divider means and a fuel chamber on the opposite side of said divider means, a through aperture in said divider means for connecting said control chamber in fluid communication with said fuel chamber, a check valve openable inwardly into said fuel chamber from said aperture, said divider means providing a seat for said check valve when said check valve is in a closed position, said injector body means having an inlet to said fuel chamber connectable to a source of pressurized fuel and a spray outlet from said fuel chamber opposite said aperture, an injection valve openable inwardly in said fuel chamber from said spray outlet, a seat in said injector body means for said injection valve when said injection valve is in a closed position, said check valve having a guide bore therein providing the sole guiding support for said injection valve during opening and closing movements thereof and through which fluid pressure in said control chamber acts against said check valve in a closing direction, and spring means operatively connected to said check valve and to said injection valve to normally hold them in closed positions against their respective seats, said spring means being yieldable to accommodate both opening of said check valve by fluid pressure above a predetermined value in said control chamber and to accommodate opening of the injection valve by fluid pressure in said fuel chamber.

3. A fuel injector nozzle including an injector body means providing a compartment therein, a divider means fixed to said injector body means to divide said compartment into a control chamber to receive leakage of fuel on one side of said divider means and a fuel chamber means on the opposite side of said divider means, an aperture means in said divider means connecting said control chamber to said fuel chamber, said injector body means having an inlet connectable at one end to a source of pressurized fuel and having its other end opening into said fuel chamber, said injector body means further having a spray tip and with spray orifices therethrough at its end opposite said control chamber, a check valve movably positioned in said fuel chamber for movement between open and closed positions to control flow from said control chamber through said aperture means to said fuel chamber and to prevent flow in the opposite direction, said check valve consisting of a sleeve terminating with an external annular flange at its end adjacent said aperture means, said divider means providing a closure seat for said flange in said fuel chamber surrounding said aperture means, an injection valve operatively positioned in said fuel chamber for controlling discharge of fluid from said fuel chamber out through said spray orifices, a closure seat for said injection valve in said fuel chamber surrounding said spray orifices, said injection valve having a stem portion at its end opposite said spray orifices that is slidably received by said check valve whereby said check valve and said injection valve provide the sole lateral support for each other during their opening and closing movements, and a spring means operatively connected to said check valve and to said injection valve for normally biasing said injection valve and said check valve to their respective closed positions, said sring means being yieldable whereby to accommodate both opening movement of said check valve by fluid pressure in said control chamber due to leakage of fuel past mating parts of said check valve and said injection valve when the pressure of fuel in said fuel chamber is reduced and opening of the injection valve by high pressure fluid in said supply chamber, said high pressure fluid together with the bias of said spring means effecting closure of said check valve.

* * * * *

UNITED STATES PATENT AND TRADEMARK OFFICE

CERTIFICATE OF CORRECTION

PATENT NO. : 4,200,231

DATED : April 29, 1980

INVENTOR(S) : Richard S. Knape

It is certified that error appears in the above-identified patent and that said Letters Patent are hereby corrected as shown below:

Column 2, line 19, "featues" should read -- features --.

Column 6, line 46, "sring" should read -- spring --.

Signed and Sealed this

*First* Day of *July 1980*

[SEAL]

*Attest:*

SIDNEY A. DIAMOND

*Attesting Officer*

*Commissioner of Patents and Trademarks*